US010816187B2

(12) United States Patent
Thatcher

(10) Patent No.: US 10,816,187 B2
(45) Date of Patent: Oct. 27, 2020

(54) WAIST LIGHT ASSEMBLY AND METHOD OF USE

(71) Applicant: Elite Creators, LLC, St. George, UT (US)

(72) Inventor: Bryce Thatcher, Saint George, UT (US)

(73) Assignee: Elite Creators, LLC, St. George, UT (US)

( * ) Notice: Subject to any disclaimer, the term of this patent is extended or adjusted under 35 U.S.C. 154(b) by 0 days.

(21) Appl. No.: 16/689,861

(22) Filed: Nov. 20, 2019

(65) Prior Publication Data

US 2020/0158326 A1 May 21, 2020

Related U.S. Application Data

(60) Provisional application No. 62/769,920, filed on Nov. 20, 2018.

(51) Int. Cl.

| | |
|---|---|
| ***F21V 33/00*** | (2006.01) |
| ***F21V 23/02*** | (2006.01) |
| ***F21V 21/14*** | (2006.01) |
| ***G08B 5/00*** | (2006.01) |
| *A41F 9/00* | (2006.01) |

(52) U.S. Cl.

CPC ..... *F21V 33/0008* (2013.01); *F21V 21/145* (2013.01); *F21V 23/023* (2013.01); *G08B 5/008* (2013.01); *A41F 9/00* (2013.01)

(58) Field of Classification Search

CPC .. F21V 33/0008; F21V 21/145; F21V 23/023; G08B 5/008; A41F 9/00; A41F 9/025; A41D 1/002

See application file for complete search history.

(56) References Cited

U.S. PATENT DOCUMENTS

| | | | | | |
|---|---|---|---|---|---|
| 1,217,666 | A * | 2/1917 | Thulin | F21L 4/00 | 362/103 |
| 1,525,374 | A * | 2/1925 | Craig | F21L 2/00 | 362/105 |
| 4,849,863 | A * | 7/1989 | Gallegos | A41D 13/01 | 362/108 |
| 5,045,979 | A * | 9/1991 | Stevens | A41F 9/002 | 224/679 |
| 5,255,168 | A * | 10/1993 | Stevens | F21L 4/04 | 362/103 |
| 5,359,501 | A * | 10/1994 | Stevens | A41F 9/002 | 362/108 |
| 6,056,412 | A * | 5/2000 | Atlee | F21L 15/14 | 224/660 |
| 6,908,208 | B1 * | 6/2005 | Hyde | F21L 4/06 | 362/105 |
| 9,664,372 | B1 * | 5/2017 | Rothschild | F21V 33/0008 | |

(Continued)

*Primary Examiner* — Zheng Song

(74) *Attorney, Agent, or Firm* — Gurr Brande & Spendlove, PLLC; Robert A. Gurr

(57) ABSTRACT

A waist light assembly has a light housing including one or more light-emitting devices in the light housing, and a battery housing separate from the light housing, the battery housing being coupled to the light housing via an electrical wire. The waist light assembly may be used in combination with a waist belt, the waist belt having a front pad for securing the light housing and a rear pad for securing the battery housing.

7 Claims, 6 Drawing Sheets

(56) References Cited

U.S. PATENT DOCUMENTS

| | | | | |
|---|---|---|---|---|
| 2008/0316734 | A1* | 12/2008 | Spartano | F21V 21/084 362/105 |
| 2014/0192517 | A1* | 7/2014 | Alvarado | F21V 21/145 362/103 |
| 2017/0219194 | A1* | 8/2017 | Hatfield | A41D 1/21 |
| 2018/0058681 | A1* | 3/2018 | Arave | F21L 4/06 |

* cited by examiner

WAIST LIGHT ASSEMBLY AND METHOD OF USE

CROSS-REFERENCE TO RELATED APPLICATIONS

This application claims the benefit of U.S. Provisional Application Ser. No. 62/769,920, filed on Nov. 20, 2018, which is incorporated herein by reference.

TECHNICAL FIELD

The present disclosure relates to flashlights. More particularly, the present disclosure relates to a waist light assembly that couples to a user's body for various physical activities.

BACKGROUND

Flashlights, spotlights, and various other forms of lighting have been used for many activities. One such activity is night walking, running, or hiking. There are many forms of lighting that exist to accompany a user on a typical night walk, run, or hike. For example, a user may use a simple hand-held light or may opt for a body-mounted light, such as a headlamp. While these lights are useful for activities such as walking and spotlighting, they do not function well for hiking and/or running. For example, when hiking, a user may often need their hands to assist in climbing or hiking, making the hand-held light less than desirable. When running, the arms and hands swing back-and-forth, which results in reduced trail illumination and can produce ill/confusing effects to the viewer as the light swings. Accordingly, many users have attempted to fasten a light to their head (e.g., a headlamp). While this style of light removes the issues with the swinging light in a hand, it fails to illuminate where a user is stepping and, rather, illuminates where the user is looking. Further, even if the headlamp is aimed downwardly at the ground, it fails to produce accurate terrain views that make for easy running due to the angle of the light. The light can also impact the user's view when it is sufficiently angled downward in an attempt to illuminate the trail. If the user looks downward to see the trail, the light likewise shines directly downward and has a smaller radius, making it more difficult to see upcoming objects.

Further, flashlights and headlamps can bounce significantly when running, due to the overall weight of the unit (e.g., housing, battery, bezel combination). In addition to the undesired movement, the weight may also be uncomfortable for a user. In particular, ultra-marathon runners can experience significant fatigue when the night portion of the marathon begins—and any additional weight or pressure on the stomach or head only compounds the problem.

As a result, there is a need for a waist light assembly that allows the user to distribute the weight around the body, that is properly angled so as to create the best view of the terrain when running, and that is comfortable to a user—particularly a marathoner. The present invention seeks to solve these needs and others.

SUMMARY OF EXAMPLE EMBODIMENTS

In one embodiment, a waist light assembly comprises a light housing, one or more light-emitting devices (e.g., Light-Emitting Diodes (LEDs), High Intensity Discharge Lamps (HIDs), Incandescent bulbs, etc.) in the light housing, and a battery housing separate from the light housing, the battery housing being coupled to the light housing via an electrical wire.

In one embodiment, the waist light assembly further comprises a waist belt, the waist belt comprising a front portion (e.g., front pad) for securing the light housing and a rear portion (e.g., rear pad) for securing the battery housing. In one embodiment, the waist belt has a contoured form-factor.

One method of use comprises a user securing the light housing to the front portion of the waist belt, securing the battery housing to the rear portion of the waist belt, and securing the waist belt to the user wherein the front portion of the waist belt is on a front of a user and the rear portion is on the rear portion of a user (or elsewhere on the user).

DETAILED DESCRIPTION OF EXAMPLE EMBODIMENTS

Figure 1:
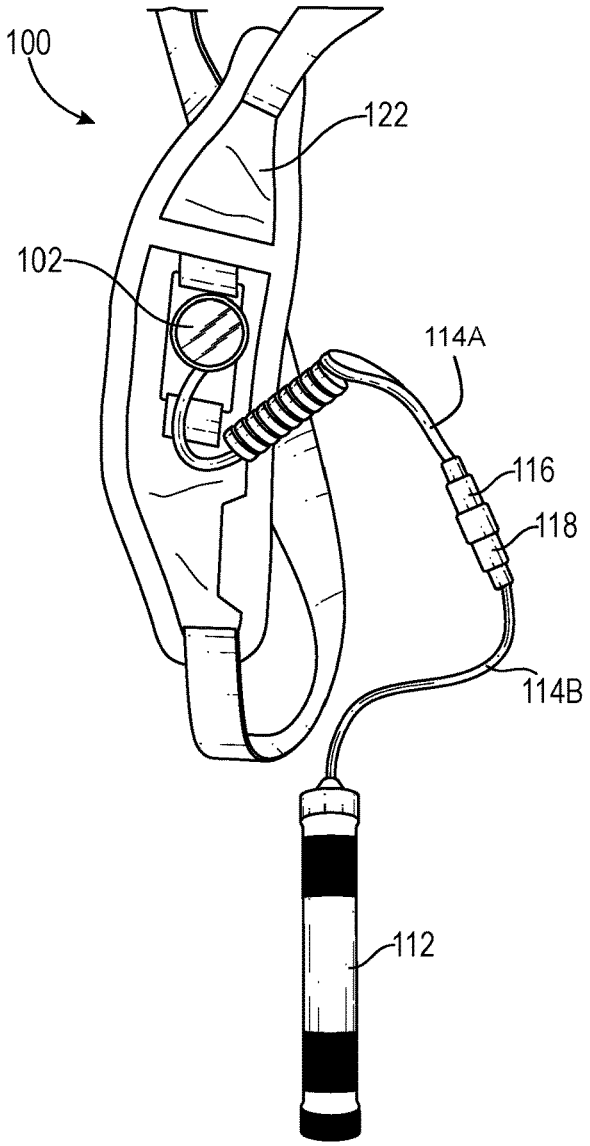
FIG. 1 is a perspective view of a waist light assembly.
Figure 2:
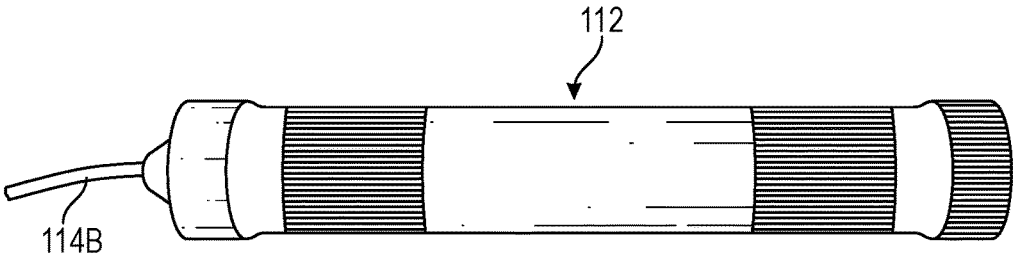
FIG. 2 is a side elevation view of a battery housing of a waist light assembly.
Figure 3:
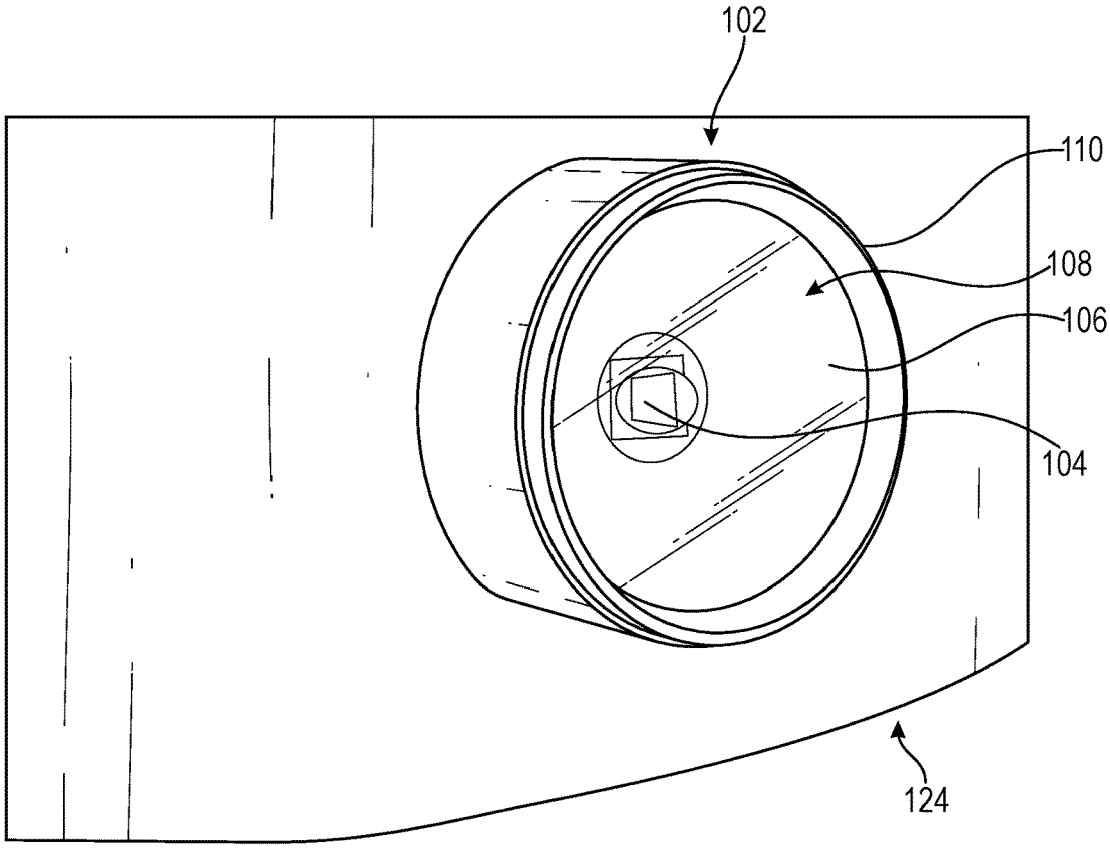
FIG. 3 is a front perspective view of a light housing of a waist light assembly.
Figure 4:
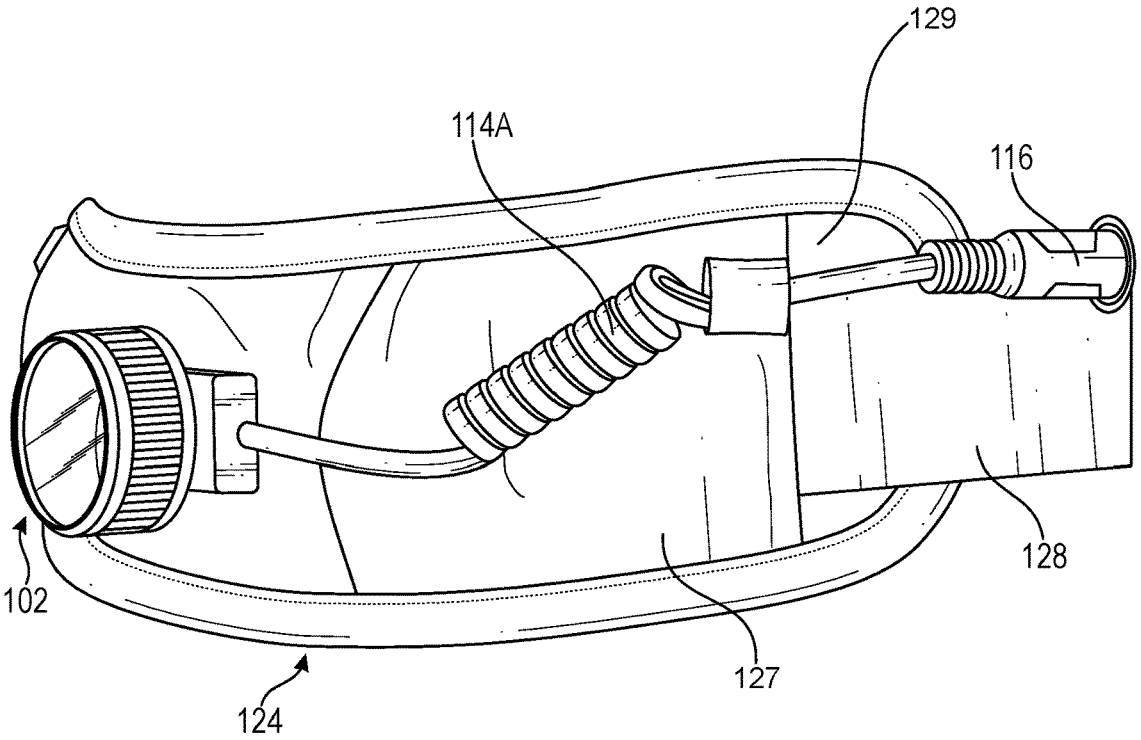
FIG. 4 is a front, side perspective view of a light housing secured to a waist belt of a waist light assembly.

The following descriptions depict only example embodiments and are not to be considered limiting in scope. Any reference herein to "the invention" is not intended to restrict or limit the invention to exact features or steps of any one or more of the exemplary embodiments disclosed in the present specification. References to "one embodiment," "an embodiment," "various embodiments," and the like, may indicate that the embodiment(s) so described may include a particular feature, structure, or characteristic, but not every embodiment necessarily includes the particular feature, structure, or characteristic. Further, repeated use of the phrase "in one embodiment," or "in an embodiment," do not necessarily refer to the same embodiment, although they may.

Reference to the drawings is done throughout the disclosure using various numbers. The numbers used are for the convenience of the drafter only and the absence of numbers in an apparent sequence should not be considered limiting and does not imply that additional parts of that particular embodiment exist. Numbering patterns from one embodiment to the other need not imply that each embodiment has similar parts, although it may.

Accordingly, the particular arrangements disclosed are meant to be illustrative only and not limiting as to the scope of the invention, which is to be given the full breadth of the appended claims and any and all equivalents thereof. Although specific terms are employed herein, they are used in a generic and descriptive sense only and not for purposes of limitation. Unless otherwise expressly defined herein, such terms are intended to be given their broad, ordinary, and customary meaning not inconsistent with that applicable in the relevant industry and without restriction to any specific embodiment hereinafter described. As used herein, the article "a" is intended to include one or more items. When used herein to join a list of items, the term "or" denotes at least one of the items, but does not exclude a plurality of items of the list. For exemplary methods or processes, the sequence and/or arrangement of steps described herein are illustrative and not restrictive.

It should be understood that the steps of any such processes or methods are not limited to being carried out in any particular sequence, arrangement, or with any particular graphics or interface. Indeed, the steps of the disclosed processes or methods generally may be carried out in various sequences and arrangements while still falling within the scope of the present invention.

The term "coupled" may mean that two or more elements are in direct physical contact. However, "coupled" may also mean that two or more elements are not in direct contact with each other, but yet still cooperate or interact with each other.

The terms "comprising," "including," "having," and the like, as used with respect to embodiments, are synonymous, and are generally intended as "open" terms (e.g., the term "including" should be interpreted as "including, but not limited to," the term "having" should be interpreted as "having at least," the term "includes" should be interpreted as "includes, but is not limited to," etc.).

As previously discussed, there is a need for a waist light assembly that allows the user to distribute the weight around the body, that is properly angled so as to create the best view of the terrain when running, and that is comfortable to a user—particularly a marathoner. The waist light assembly described below solves these, and other, problems.

In one embodiment, as shown in FIGS. 1-4, a waist light assembly 100 comprises a light housing 102 having one or more light-emitting devices 104 (e.g., Light-Emitting Diodes (LEDs), High Intensity Discharge Lamps (HIDs), Incandescent bulbs, etc.) within the light housing 102. As shown best in FIG. 3, the light housing 102 is very minimal, comprising the light-emitting device 104, a reflector 106, a lens 108, and a bezel 110. As a result of the light housing 102 being so minimal, the weight is extremely reduced, which allows a user to mount the light housing 102 to a variety of locations without noticing the weight. Further, in a preferred embodiment, the reflector 106 has a shorter, more flattened contoured shape so as to create a very wide beam. Current lights in the art have a taller contoured reflector, which creates a beam having a narrower angle. This creates a noticeable light-dark line that is visible to the runner as part of their natural eye movements. As the user looks forward to navigate the trail, he/she will naturally glance through their line of sight. When there is a dark line in their line of sight from the narrow angle of the flashlight, the eyes naturally bounce back and forth from the dark part of view to the light part of view. Each time this occurs, the eyes try to adjust for the difference in brightness from dark to light. This is very fatiguing to the runner's eyes and can cause headaches and dizziness over time.

Accordingly, the shorter, flat-shaped reflector 106 of light housing 102 corrects these problems by creating a wide-angle beam that effectively removes the light-dark line. As a result, an even, natural light is produced for the runner. This creates a natural gaze from side-to-side with exactly the same intensity of light, which reduces fatigue and allows a user/runner to focus on the finish line or completing the activity at hand. In an effort to make the light easy to actuate for a user, the bezel 110 is configured to function as both the on/off switch and intensity control (e.g., rheostat). In order to accommodate users wearing gloves or to facilitate easy adjustment while running, the bezel 110 may be configured as follows: a soft touch turns the light on/off; soft pressing and holding adjusts the brightness between low, medium, and high. In an alternative embodiment, the user may simply rotate the bezel 110 to adjust the intensity or turn the light on/off. While the actuating mechanism is located on the bezel, it will be appreciated that the actuating mechanism may be positioned in other locations on the waist light assembly 100, such as on the battery housing.

Figure 5:
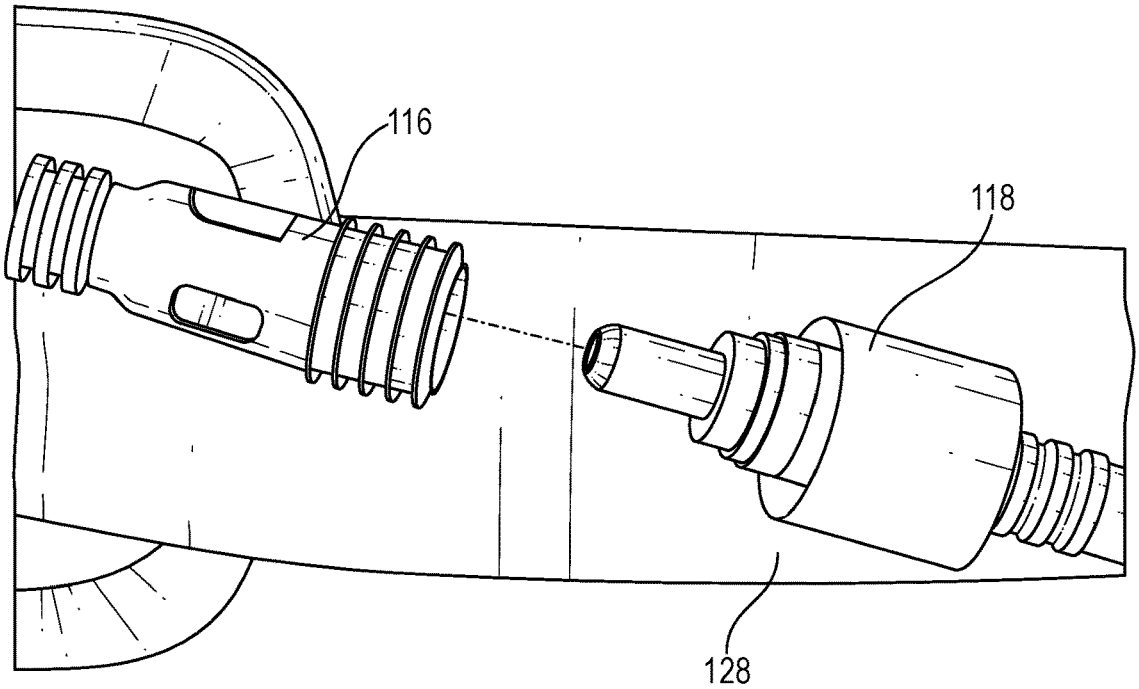
FIG. 5 is side perspective view of the electrical couplers, decoupled, of a light housing and battery housing of a waist light assembly.

The waist light assembly 100 further comprises a battery housing 112 separate from the light housing 102, the battery housing 112 being coupled to the light housing 102 via an electrical wire 114A, 114B. In one embodiment, as best shown in FIGS. 1 and 5, the light housing 102 and the battery housing 106 may each have electrical couplers 116, 118, respectively. For example, the female coupler 116 of the light housing 102 may receive male coupler 118 of the battery housing 112. Female coupler 116 may be distanced from the light housing 102 via the length of the electrical wire 114A. Likewise, the male coupler 118 may be distanced from the battery housing 112 via the length of electrical wire 114B. As appreciated, this allows the light housing 102 and the battery housing 112 to be at different locations on a person's body, yet electrically coupled to one another. This allows the weight of the battery housing 112 to be separate from the light housing 102, which keeps the light housing 102 from bouncing as much and keeps the light housing 102 more comfortable for a user to wear. Further, the light housing 102 may be vertically and/or horizontally adjustable so as to accommodate changes in terrain or activity. For example, a user that is running up a hill may desire to adjust the light housing 102 such that the beam is aimed higher up the hill. This may be accomplished by using a swivel bracket, tilting bracket, or other adjustable bracket or coupling means. Current tilting lights in the prior art are used in headlamps and only allow the light to tilt downward, not upward. In contrast, the waist belt assembly 100 allows the light housing 102 to tilt upwardly and downwardly, which allows a user to place the waist light assembly 100 on their waist, yet still have the light aiming upward during an ascent.

Several benefits are realized by having the battery housing 112 separate from the light housing 102. In particular, a larger battery may be used that won't interfere with the mounting position of the light housing 102. For example, currently in the art, the battery and the light are in the same housing. Therefore, if a larger battery is used, this means that the user will have increased weight on the waist, head, or other mounting area of the light. In addition, when the battery is coupled to the light, it places all of the weight in one location, which can be burdensome on a user. As discussed earlier, this additional weight can be significantly uncomfortable for a user. As a result, lights in the art currently have smaller batteries, and therefore, shorter lifespans.

Accordingly, the waist light assembly 100 described herein solves this problem by separating the battery from the light by using the battery housing 112 and light housing 102.

For example, the battery may then be secured to a user in a more comfortable position without interfering with the light. As a result, the battery may also be much larger, which increases the lifespan of the light and the length for which a user may run. Lights in the prior art dim as the battery power lessens. This creates additional fatigue to a user as their eyes constantly adjust to the ever-changing beam brightness. In contrast, the light-emitting device 104 used herein remains at a constant brightness, without fading. Accordingly, a larger battery is beneficial as maintaining a constant brightness uses more energy. The battery housing 112 accomplishes this by providing for a significant battery to be used therein. However, it will be noted that any size battery may be used, allowing a user to decide the length of the brightness. In other words, the battery housing 112 may be produced in several sizes.

A user may easily switch the battery housing 112 being used in connection with the light housing 102 for their desired activity. For example, a user may select a smaller battery housing 112 for a short 30-minute run and a larger battery housing 112 for a run of several hours. The couplers 116, 118 allow for this easy adjustment without a user needing to change the light housing 102.

Figure 6:
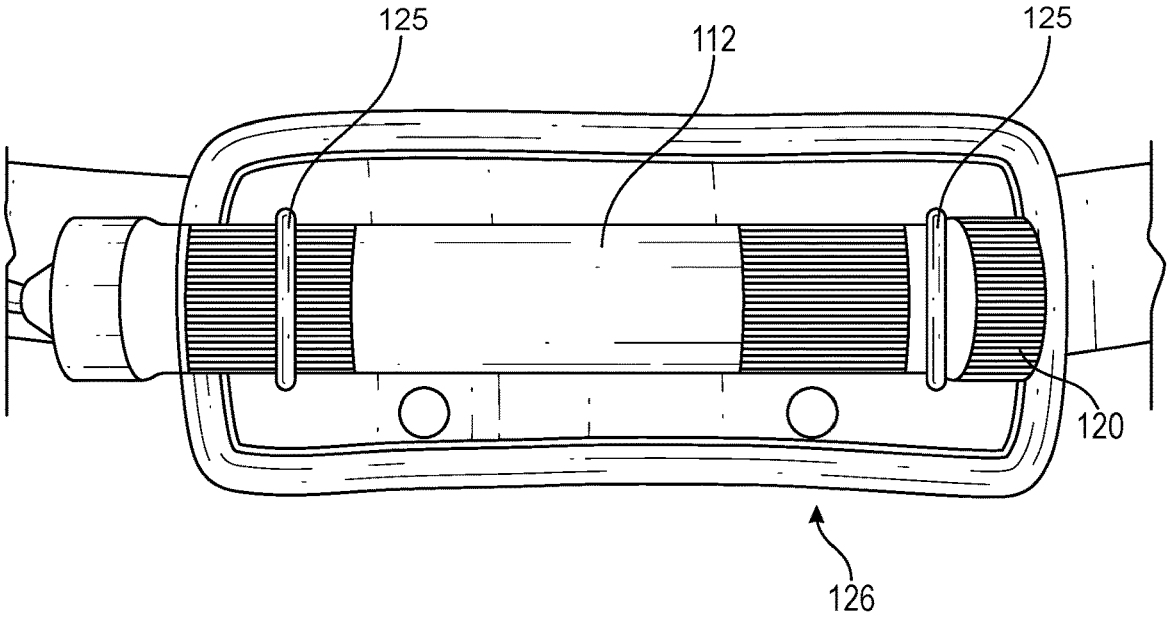
FIG. 6 is a side elevation view of a battery housing secured to a waist belt of a waist light assembly.
Figure 7:
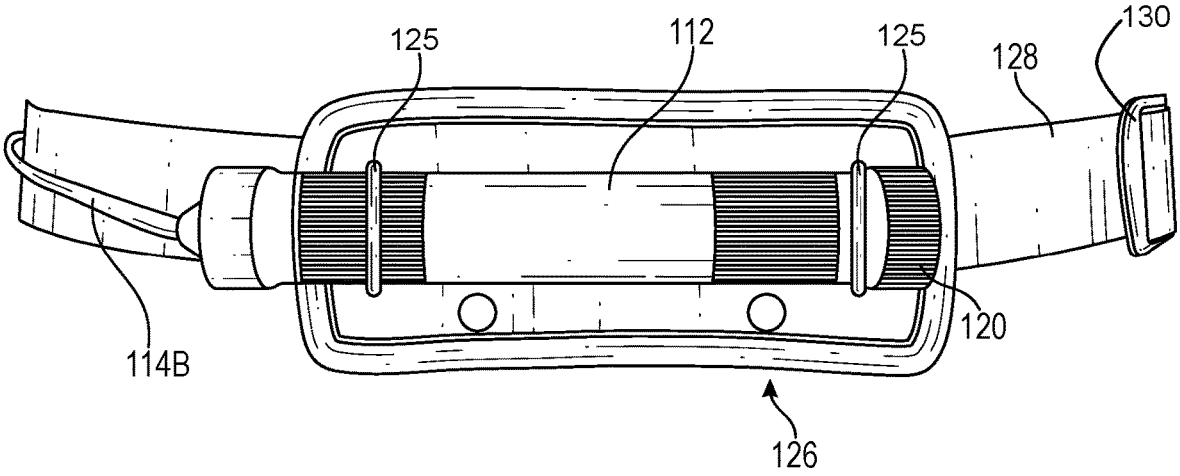
FIG. 7 is a side elevation view of a battery housing secured to a waist belt of a waist light assembly.

As shown in FIGS. 6-7, the battery housing 112 may be secured to a rear pad 126. Rear pad 126 (and front pad 124, discussed later) may comprise textiles alone, but may additionally include foam, paper backing, or other materials suitable to secure the battery housing 112 thereto. The rear pad 126 is ideally flexible so as to be comfortable when secured to a user. Because the rear pad 126 has a greater surface area than the battery housing 112 alone, it is more comfortably secured to a user. It will be appreciated that the battery housing 112 may be removably attachable to the rear pad 126 (such as by using elastics, straps, loops 125, etc.) or may be permanently secured thereto. While a rear pad 126 is shown, it is not required. For example, a user may place the battery housing 112 in a pocket, pouch, or backpack as well.

Figure 8:
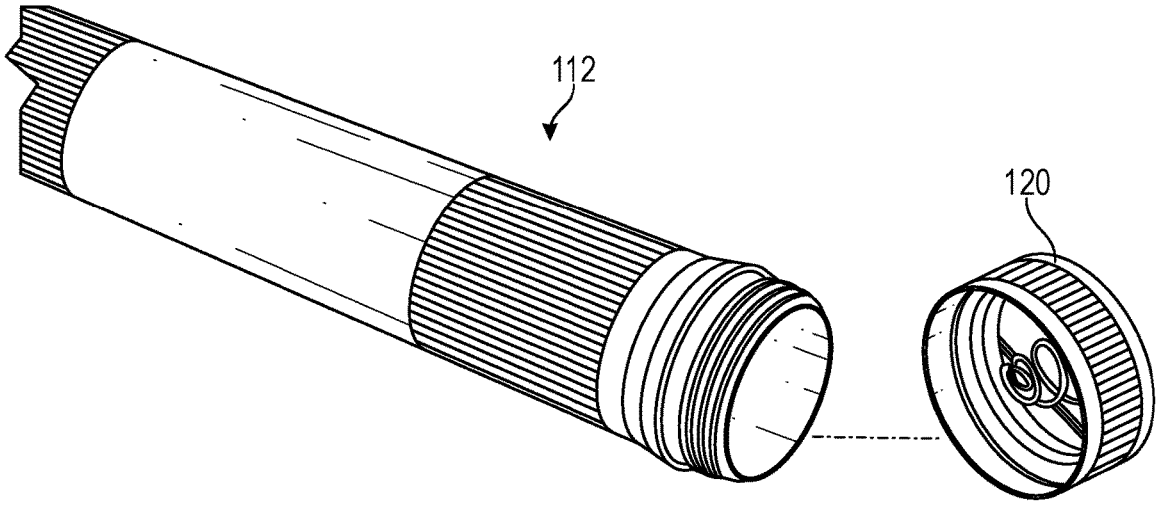
FIG. 8 is a side, rear perspective view of a battery housing with the end open to receive one or more batteries.

Referring to FIG. 8, battery housing 112 may have removable end cap 120 allowing a user to add/remove batteries to the battery housing 112. The removable end cap 120 may be a screw cap that the user can unscrew to remove or add batteries. While a screw cap is shown, there may be other coupling mechanisms used for the removable end cap 120, such as a slide style port for batteries.

In one embodiment, the battery housing 112 is tubular and sized so as to receive a plurality of batteries end-to-end. However, any shape and configuration of housing may be used. In one embodiment, the battery housing 112 may be a typical cellphone power bank, with a standard micro-USB or USB-C plug and cable coupling the power bank to the light housing 102. In other words, the cable 114A may be removably couplable to the light housing 102 using a USB connector. This allows a user to purchase and use any number of styles of battery for use with the light housing 102. As appreciated from the foregoing, the battery housing 112 may be secured to a user in any number of comfortable positions, such as the back, a running pack, a vest, or other positions as selected by the user.

Figure 9:
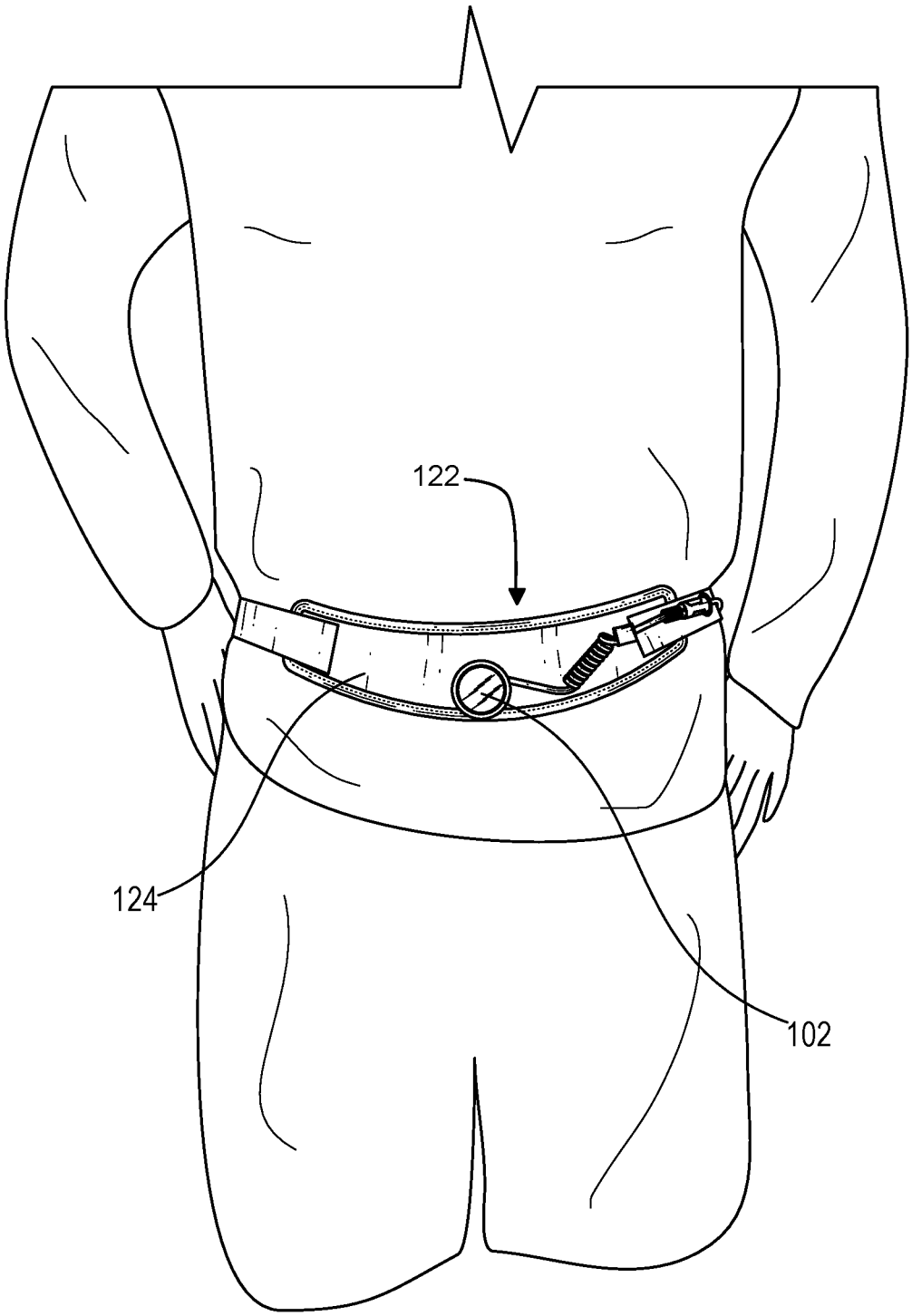
FIG. 9 is a front perspective view of a user with the light housing of the waist light assembly secured to their waist.
Figure 10:
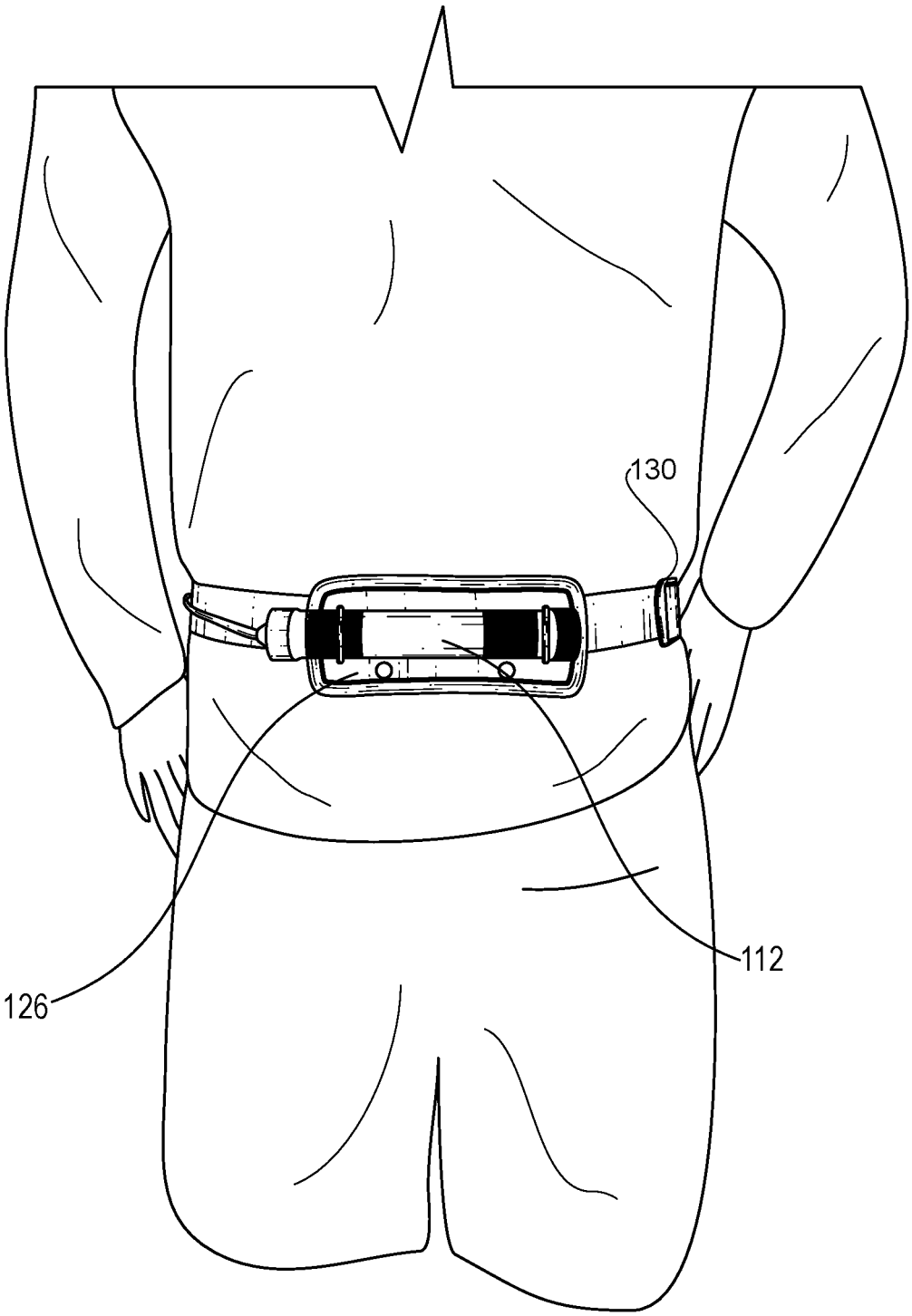
FIG. 10 is a perspective view of a back of a user with a battery housing of a waist light assembly secured thereto.

In one embodiment, as best shown in FIGS. 9-10, the waist light assembly 100 may further comprise a waist belt 122. In one embodiment, the waist belt 122 comprises limited-stretch elastic 128. Limited-stretch means that the elasticity is reduced. In other words, if a typical elastic is capable of stretching 100% of its length, the limited-stretch elastic would stretch less than 50%, and ideally, about 20%. This limited-stretch elastic allows for natural body movement without restriction, yet prohibits unnecessary movement or bouncing of the waist light assembly 100 during use. The waist belt 122 may further comprise reflective materials to aid the wearer in being seen by others when running, particularly on roads. The waist belt 122 comprises a front pad 124 (also see FIG. 4) for securing the light housing 102, a rear pad 126 (also see FIG. 6) for securing the battery housing 112, and a belt coupler 130. As shown, the waist belt 122 has a first height, with the front pad 124 and rear pad 126 each having a height greater than the height of the waist belt 122. The height of the front pad 124 and rear pad 126 may be the same, although they may also be different. Having greater heights for the front pad 124 and rear pad 126 helps maintain comfort on a user by dispersing the pressure generated by the light housing 102 and battery housing 112 on the wearer's body. The belt coupler 130 may be, but is not limited to, a buckle having a male coupler and a female coupler. It will be appreciated that the belt coupler may also be hook and loop, clip-on, clip and latch, etc. In an alternate embodiment, the waist belt 122 may be continuous and a user applies the waist belt 122 by stepping through and pulling it around their waist. In one embodiment, the front pad 124 and rear pad 126 may be removably attachable to the waist belt 122. For example, the front pad 124 may have a front layer 127 and a rear layer 129 creating a space therebetween for the limited stretch elastic 128. To remove the front pad 124, a user may undo the belt coupler 130 and slide the limited stretch elastic 128 from the front pad 124. Accordingly, a user may use the limited stretch elastic 128 without the pads 124, 126 if desired.

In one embodiment, the waist belt 122 has a contoured form-factor. This shape takes into account that most athletic bodies have a smaller waist than hips. The contoured shape naturally allows the waist light assembly 100 to ride lower with stability and less tension on the waist. Less tension means less pressure on the stomach, which equates to a better experience for a user.

Accordingly, in one embodiment, as best seen in FIGS. 9-10, a method of use of the waist light assembly 100 comprises a user securing the light housing 102 to the front pad 124 of the waist belt 122, securing the battery housing 112 to the rear pad 126 of the waist belt 122, and securing the waist belt 122 to the user wherein the front pad 124 of the waist belt 122 is on a front of a user. With the weight distributed around the body, the user can easily and comfortably run or participate in other activities.

For running, the waist is the ideal position for the light housing 102, as the movement is minimal, and the beam creates shadows that aid a user to identify terrain variances/obstacles such as rocks. While the light housing 102 and battery housing 112 are shown as secured to a waist belt 122, other configurations are possible. For example, the light housing 102 may be coupled to a headband for use on the head, or may be coupled to other locations, such as a vest, shorts, or pack. Further, the battery housing 112 may likewise be located at various positions on the body and not exclusively in the small of the back, as shown in FIG. 10.

As appreciated from the foregoing, the waist light assembly 100 disclosed herein solves the need for a waist light that allows the user to distribute the weight around the body, that is properly angled so as to create the best view of the terrain when running, and that is comfortable to a user—particularly a marathoner.

Exemplary embodiments are described above. No element, act, or instruction used in this description should be construed as important, necessary, critical, or essential unless explicitly described as such. Although only a few of the exemplary embodiments have been described in detail herein, those skilled in the art will readily appreciate that many modifications are possible in these exemplary embodiments without materially departing from the novel teachings and advantages herein. Accordingly, all such modifications are intended to be included within the scope of this invention.

What is claimed is:

1. A waist light assembly, comprising:

a waist belt having a first height and made of limited stretch elastic, the waist belt sized so as to circumvent a user's waist, the waist belt further comprising:

a front pad comprising:

i. a front layer;

ii. a rear layer for engaging an abdomen area of the user;

iii. a space between the front layer and rear layer to allow the waist belt to pass therebetween;

iv. foam for padding within the front pad;

the front pad having a second height greater than the first height of the waist belt, the second height of the front pad distributing pressure experienced by a user;

a rear pad for engaging the user's back, the rear pad comprising foam and having a third height greater than the first height of the waist belt, the third height of the rear pad distributing pressure experienced by a user;

a light housing couplable to the front pad, the light housing comprising at least one light-emitting device, a reflector, a lens, a bezel, and an electrical wire with an electrical coupler thereon;

a cylindrical battery housing separate from the light housing and couplable to the rear pad in a horizontal position, the battery housing comprising an electrical wire with an electrical coupler thereon; and wherein the electrical coupler of the light housing is couplable to the electrical coupler of the battery housing via one or more electrical wires.

2. The waist light assembly of claim 1, wherein a battery is removably insertable within the battery housing.

3. The waist light assembly of claim 1, wherein the front pad is contoured to fit bodies with smaller waists than hips.

4. The waist light assembly of claim 1, wherein the limited stretch elastic stretches about 20%.

5. The waist light assembly of claim 1, wherein the bezel controls the ON/OFF status of the light emitting device.

6. A method of using a waist light assembly on a waist of a user, the method comprising:

coupling a light housing to a front pad of a waist belt, the front pad comprising a front layer, a rear layer for engaging an abdomen area of the user, and a space between the front layer and rear layer to allow the waist belt to pass therebetween;

coupling a battery housing in a horizontal position to a rear pad of the waist belt;

coupling an electrical coupler of the light housing to an electrical coupler of the battery housing; and securing the waist belt to a user with the front pad secured to a front of the user and the rear pad secured to a back of the user.

7. A waist light assembly, comprising:

a waist belt having a first height and made of limited stretch elastic, the waist belt sized so as to circumvent a user's waist, the waist belt further comprising:

a front pad comprising:

i. a front layer;

ii. a rear layer for engaging an abdomen area of the user; and iii. a space between the front layer and rear layer to allow the waist belt to pass therebetween;

the front pad having a second height greater than the first height of the waist belt, the second height of the front pad distributing pressure experienced by a user;

a rear pad for engaging the user's back, the rear pad having a third height greater than the first height of the waist belt, the third height of the rear pad distributing pressure experienced by a user;

a light housing couplable to the front pad, the light housing comprising at least one light-emitting device, a reflector, a lens, a bezel, and an electrical wire with an electrical coupler thereon;

a battery housing separate from the light housing and couplable to the rear pad, the battery housing comprising an electrical wire with an electrical coupler thereon; and wherein the electrical coupler of the light housing is couplable to the electrical coupler of the battery housing via one or more electrical wires.

* * * * *